US009578945B2

(12) United States Patent
Han

(10) Patent No.: US 9,578,945 B2
(45) Date of Patent: Feb. 28, 2017

(54) HAIR DRYER PIK ATTACHMENT

(71) Applicant: Kiss Nail Products, Inc., Port Washington, NY (US)

(72) Inventor: Kyu Sang Han, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 14/528,710

(22) Filed: Oct. 30, 2014

(65) Prior Publication Data

US 2016/0120286 A1 May 5, 2016

(51) Int. Cl.

*A45D 20/12* (2006.01)
*A45D 20/00* (2006.01)
*A45D 20/52* (2006.01)

(52) U.S. Cl.

CPC ..... *A45D 20/12* (2013.01); *A45D 20/00* (2013.01); *A45D 20/122* (2013.01); *A45D 20/52* (2013.01)

(58) Field of Classification Search

CPC .... A45D 20/12; A45D 20/122; A45D 20/148; A45D 20/52; A45D 20/50

USPC ..... 132/271; D28/18

See application file for complete search history.

(56) References Cited

U.S. PATENT DOCUMENTS

| | | | | | |
|---|---|---|---|---|---|
| 3,949,765 | A * | 4/1976 | Vallis | 132/120 | |
| 4,417,595 | A * | 11/1983 | Okumura et al. | 132/313 | |
| 4,538,362 | A * | 9/1985 | Andis | 34/97 | |
| 4,625,738 | A * | 12/1986 | Skovdal et al. | 132/229 | |
| 5,953,829 | A * | 9/1999 | Van Den Brug et al. | 34/97 | |
| 6,009,883 | A * | 1/2000 | Morrow | A45D 2/001 132/211 | |
| 6,922,909 | B2 * | 8/2005 | Andrew et al. | 34/96 | |
| 2004/0261812 | A1 * | 12/2004 | Csavas | 132/271 | |
| 2005/0229423 | A1 * | 10/2005 | Keong | 34/96 | |
| 2009/0199864 | A1 * | 8/2009 | Smal | 132/271 | |
| 2013/0074867 | A1 * | 3/2013 | Leung | 132/271 | |

* cited by examiner

*Primary Examiner* — Tatiana Nobrega

(57) ABSTRACT

The present disclosure is directed to a hair dryer pik attachment. In one embodiment, the hair dryer pik attachment includes a base, wherein the base comprises an opening, at least one row of loose combs coupled to a top of the base, at least one row of tight combs coupled to the top of the base and adjacent to the loose combs and the opening and a hair dryer attachment portion coupled to a bottom of the base, wherein the hair dryer attachment portion comprises one or more openings on opposing sides.

14 Claims, 5 Drawing Sheets

HAIR DRYER PIK ATTACHMENT

BACKGROUND

Some individuals have a very thick and coarse hair. As a result, these individuals require the use of multiple different types of combs to straighten out the thick and coarse hair. As a result, styling the hair of individuals with thick and coarse hair can be a laborious process that requires the use of multiple types of combs or changing attachments while drying and straightening the individuals' hair.

SUMMARY

In one embodiment, the present disclosure provides a hair dryer pik attachment. In one embodiment, the hair dryer pik attachment comprises a base, wherein the base comprises an opening, at least one row of loose combs coupled to a top of the base, at least one row of tight combs coupled to the top of the base and adjacent to the loose combs and the opening and a hair dryer attachment portion coupled to a bottom of the base, wherein the hair dryer attachment portion comprises one or more openings on opposing sides.

In another embodiment, the hair dryer pik attachment comprises a base, wherein the base comprises an opening, a first means for straightening hair coupled to a top of the base, a second means for straightening and drying the hair coupled to the top of the base and adjacent to the first means for straightening the hair and a means for attaching to a hair dryer coupled to a bottom of the base, wherein the means for attaching to a hair dryer comprises one or more openings on opposing sides.

In another embodiment, the hair dryer pik attachment comprises a base, comprising a rectangular cross section having a length that is longer than a width and an opening in a center of the rectangular cross section, a first row of loose combs coupled along the length on a first side of a top of the base, a second row of loose combs coupled along the length on a second side of the base, wherein the second side is opposite the first side, a first row of tight combs coupled along the length on the first side of the top of the base and adjacent to the first row of loose combs, a second row of tight combs coupled along the length of the second side of the base and adjacent to the second row of loose combs and a hair dryer attachment portion coupled to a bottom of the base, wherein the hair dryer attachment portion comprises one or more first openings on a first portion that is coupled to the first side of the top of the base and one or more second openings on a second portion that is coupled to the second side of the top of the base.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

As discussed above, some individuals have a very thick and coarse hair. As a result, these individuals require the use of multiple different types of combs to straighten out the thick and coarse hair. As a result, styling the hair of individuals with thick and coarse hair can be a laborious process that requires the use of multiple types of combs or changing attachments while drying and straightening the individuals' hair.

Embodiments of the present disclosure provide a hair dryer pik attachment that eliminates the need to change attachments when styling thick and coarse hair. In one embodiment, the hair dryer pik attachment provides a combination of loose combs and tight combs on a single attachment that provides the ability to straighten thick coarse hair initially with the loose combs and then subsequently provides finer straightening with the tight combs.

Figure 1:
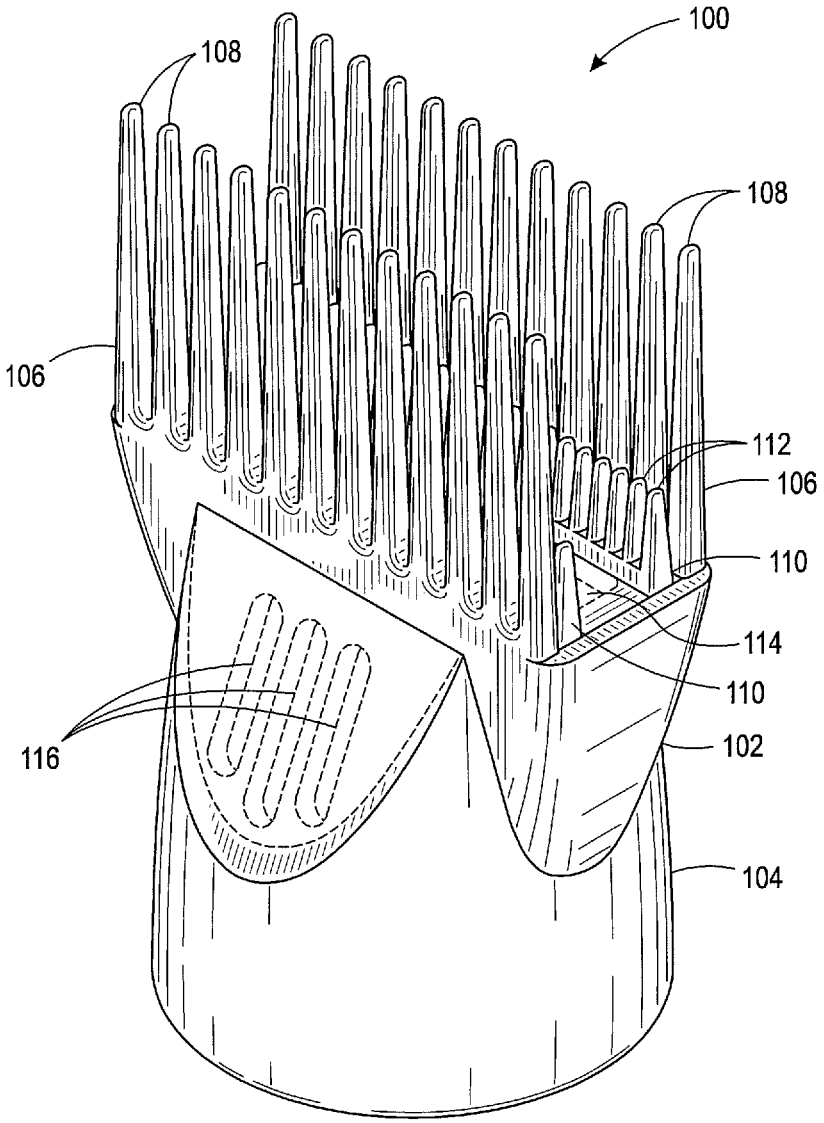
FIG. 1 depicts an isometric view of one embodiment of a hair dryer pik attachment of the present disclosure.

FIG. 1 illustrates an isometric view of one embodiment of the hair dryer pik attachment 100. In one embodiment, the hair dryer pik attachment 100 includes a base 102 and a hair dryer attachment portion 104. In one embodiment, the base 102 may include at least one row of loose combs 106, at least one row of tight combs 110 and an opening 114.

In one embodiment, the at least one row of loose combs 106 may comprise a plurality of bristles 108. In one embodiment, the at least one row of loose combs 106 may comprise 12 bristles 108. However, it should be noted that the at least one row of loose combs 106 may comprise any number of bristles depending on a size of the hair dryer pik attachment 100.

In one embodiment, the at least one row of tight combs 110 may comprise a plurality of bristles 112. In one embodiment, the at least one row of tight combs 110 may comprise 23 bristles 112. However, it should be noted that the at least one row of tight combs 110 may comprise any number of bristles depending on a size of the hair dryer pik attachment 100.

In one embodiment, the bristles 108 and the bristles 112 may have a generally have a shape that has a length that is larger than its width. For example, the bristles 108 and the bristles 112 may have a cylindrical or conic shape.

In one embodiment, spacing between each bristle 108 is greater than the spacing between each bristle 112. Examples dimensions of the spacing between the bristles 108 of the at least one row of loose combs 106 and the spacing between the bristles 112 of the at least one row of tight combs 110 are described in further detail below with respect to FIG. 6.

In one embodiment, the hair dryer attachment portion 104 may have a generally cylindrical shape that is coupled to a bottom of the base 102. In one embodiment, the hair dryer attachment portion 104 may include one or more openings 116 to prevent a hair dryer from over-heating. For example, the one or more openings 116 allows for air flow such that hot hair is not trapped inside of the hair dryer pik attachment, which may cause the hair dryer to over-heat.

Figure 2:
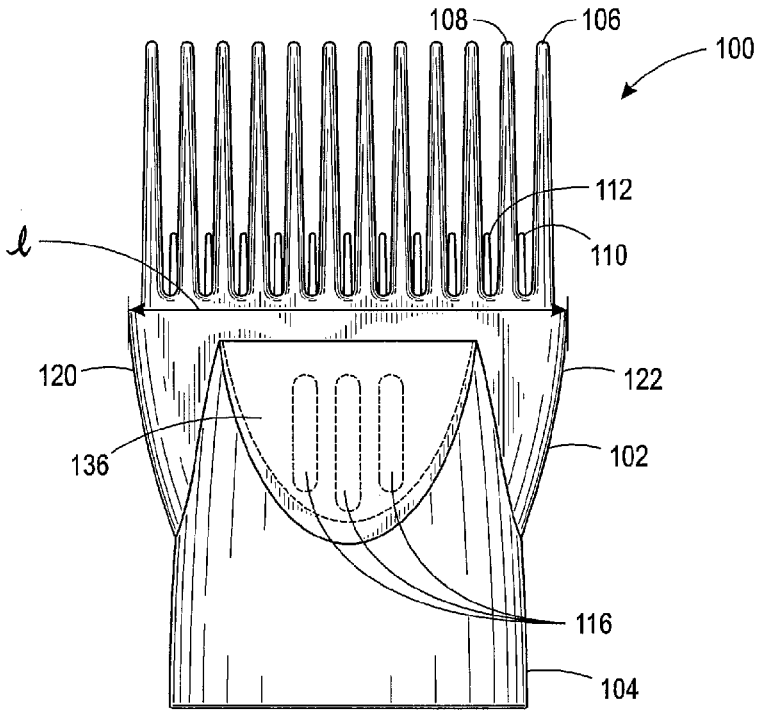
FIG. 2 depicts a front view of one embodiment of the hair dryer pik attachment of the present disclosure.
Figure 3:
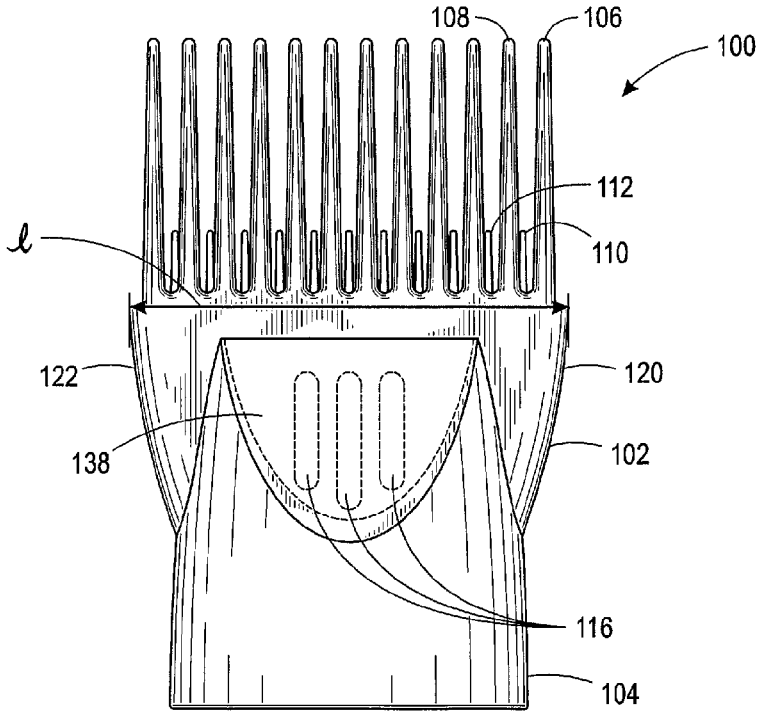
FIG. 3 depicts a back view of one embodiment of the hair dryer pik attachment of the present disclosure.

In one embodiment, the number and size of the one or more openings or vents 116 may be a function of an amount of air and temperature of the air generated by a hair dryer. For example, the more air and the hotter the air (e.g., for a larger hair dryer), the larger the one or more openings 116 may be and the more openings 116 that may be cut out in the hair dryer attachment portion 104. In one embodiment, the hair dryer attachment portion 104 may have three oval openings on each side (e.g., as illustrated in FIGS. 2 and 3 and discussed below).

In one embodiment, the at least one row of loose combs 106 may be used to initially straighten thick and coarse hair. Once the thick and coarse hair is slightly straightened, the at least one row of tight combs 110 may be used to perform finer straightening and/or further drying of the thick and coarse hair.

In one embodiment, a length or a height of the bristles 108 and the bristles 112 may be an important feature of the hair dryer pik attachment 100. For example, if the bristles 108 are too long and the bristles 112 are too short, the bristles 108 may interfere with the ability of the bristles 112 to reach the hair. For example, if the bristles 108 are too long, the bristles 108 may touch a scalp of the person before the bristles 112 of the at least one row of tight combs 110 can engage the hair. The dimensions of the bristles 108 and 112 are discussed in further detail below with respect to FIGS. 4 and 5.

In one embodiment, the at least one row of tight combs 110 may be mechanically coupled to a top side of the base 102. For example, mechanically coupling may include a snap fit, an interference fit, a sliding tab, and the like.

In one embodiment, the at least one row of tight combs 110 may be fabricated from a conductive material (e.g., a metal such as aluminum, steel, copper, and the like). The conductive material may allow the at least one row of tight combs 110 to further help dry the hair as the at least one row of tight combs 110 is simultaneously straightening the hair or performing the finer straightening. For example, heat conducted by the bristles 110 when fabricated from metal may dissipate heat into the hair while engaged with the hair to promote faster drying of the hair.

In one embodiment, the base 102, hair dryer attachment portion 104 and the at least one row of loose combs 106 may be molded as a single piece of plastic. In another embodiment, the base 102, hair dryer attachment portion 104 and the at least one row of loose combs 106 may be mechanically coupled together via locking tab, a snap fit, an interference fit, and the like.

In one embodiment, the hair dryer pik attachment 100 includes two rows of loose combs 106 and two rows of tight combs 110, as illustrated in FIG. 1. The opening 114 may be located in a center portion of the base between the two rows of loose combs 106 and the two rows of tight combs 110.

FIG. 2 illustrates a front view of the base 102 and the hair dryer attachment portion 104 and FIG. 3 illustrates a back view of the base 102 and the hair dryer attachment portion 104. In one embodiment, the front view illustrated in FIG. 2 and the back view illustrated in FIG. 3 may be symmetrical in appearance.

FIGS. 2 and 3 illustrate a length that is defined by the line l of the base 102. For example, the length may be a distance between a left side 120 of the base 102 to a right side 122 of the base 102. The at least one row of loose combs 106 and the at least one row of tight combs 110 are coupled to the top of the base 102 along a length of the base 102, as illustrated in FIGS. 2 and 3.

In one embodiment, the length of the base 102 may be a function of a desired number of bristles 108 and/or 112. For example, the more bristles 108 and 112 that are added, the longer the length of the base 102 will be and the less bristles 108 and 112 that are added, the shorter the length of the base 102 will be.

In one embodiment, the high dryer attachment portion 104 may have a generally cylindrical shape having flattened sides 136 (shown in FIG. 2) and 138 (shown in FIG. 3). The one or more openings 116 may be formed on the flattened sides 136 and 138.

Figure 4:
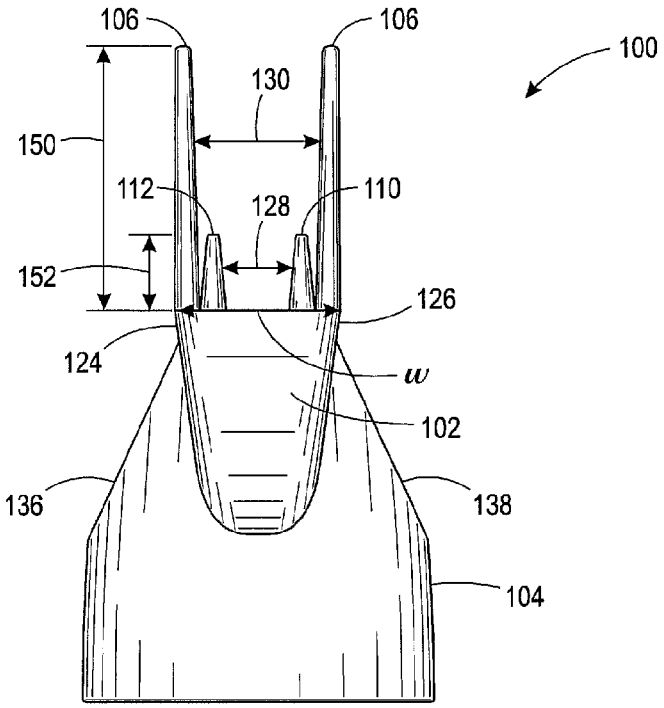
FIG. 4 depicts a first side view of one embodiment of the hair dryer pik attachment of the present disclosure.
Figure 5:
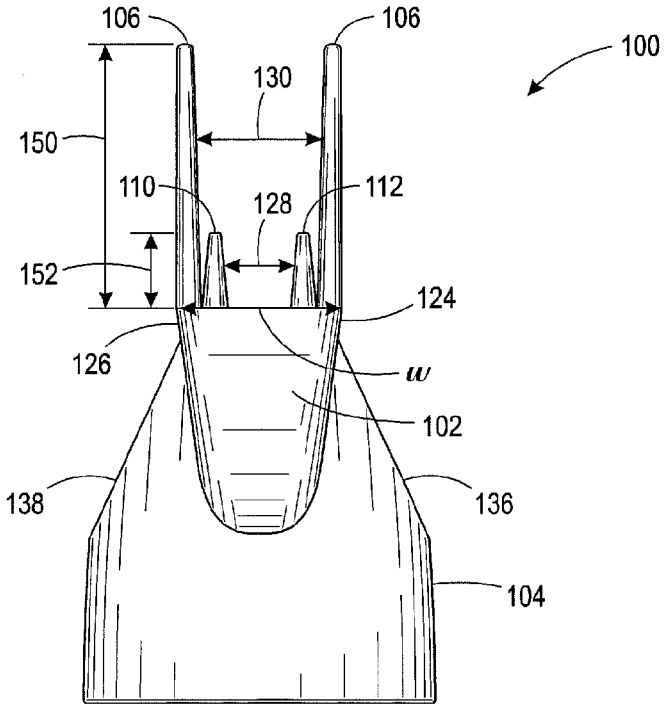
FIG. 5 depicts a second side view of one embodiment of the hair dryer pik attachment of the present disclosure.

FIG. 4 illustrates a first side view of one embodiment of the hair dryer pik attachment 100 and FIG. 5 illustrates a second side view of one embodiment of the hair dryer pik attachment 100. In one embodiment, the first side illustrated in FIG. 4 and the second side illustrated in FIG. 5 may be symmetrical in appearance.

In one embodiment, FIGS. 4 and 5 illustrate a width of the base 102 that is defined by a line w that runs from a front side 124 to a back side 126 of the base 102. The width of the base 102 may be a function of a desired size of the opening 114, the desired spacing between the at least one row of loose combs 106 and/or the desired spacing between the at least one row of tight combs 110.

In one embodiment, the spacing between two rows of the loose combs 106 may be defined by a line 130. In one embodiment, the spacing between two rows of the loose combs 106 may be 1 centimeter (cm) or greater. In one embodiment, the spacing between the two rows of the loose combs 106 is approximately 2.5 cm+/−0.5 cm.

In one embodiment, the spacing between two rows of tight combs 110 may be defined by a line 128. In one embodiment, the spacing between two rows of the tight combs 110 may be 0.5 cm or greater. In one embodiment, the spacing between the two rows of the tight combs 110 is approximately 1.5 cm+/−0.5 cm.

In one embodiment, the spacing 128 and the spacing 130 may be measured from a middle point along the length of the bristles 108 or the bristles 112. For example, the width of the bristles 108 and 112 may be wider at a bottom versus a top of the bristles. As a result, the spacing 128 and the spacing 130 may vary depending on where the spacing is measured along a length of the bristle 108 or 112.

As discussed above, the length of the bristles 108 and the length of the bristles 112 may be important in proper functioning of the hair dryer pik attachment 100. The length of the bristles 108 of the at least one loose combs 106 is illustrated by a line 150 (also referred to length 150). The line 150 may span from a bottom of the bristle 108 coupled to the top of the base 102 to a tip of the bristle 108. The length of the bristles 112 of the at least one tight combs 110 is illustrated by a line 152 (also referred to length 152). The line 152 may span from a bottom of the bristle 112 coupled to the top of the base 102 to a tip of the bristle 112.

In one embodiment, a ratio between the length 150 of the bristle 108 to the length 152 of the bristle 110 should be between 5.0 to 2.0. In one embodiment, the ratio between the length 150 of the bristle 108 to the length 152 of the bristle 110 is approximately 3.6+/−0.5.

In one embodiment, the length 150 of the bristle 108 may be approximately 2 cm or greater. In one embodiment, the length 150 of the bristle 108 is approximately 4.5 cm+/−0.5 cm. In one embodiment, the length 152 of the bristle 112 may be approximately 0.5 cm or greater, but less than the length 150 of the bristle 108. In one embodiment, the length 152 of the bristle 112 may be approximately 1.25 cm+/−0.5 cm.

Figure 6:
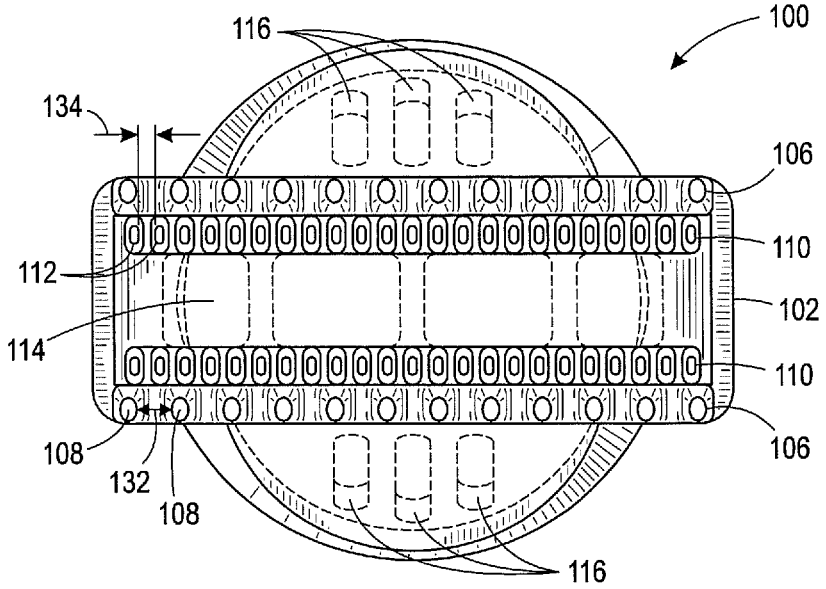
FIG. 6 depicts a top view of one embodiment of the hair dryer pik attachment of the present disclosure.

FIG. 6 illustrates one embodiment of a top view of the hair dryer pik attachment 100. In one embodiment, the base 102 may have a generally rectangular cross-sectional shape. However, it should be noted that the base 102 may include other cross-sectional shapes (e.g., an oval, a circle, a square, or any other polygon). In one embodiment, the opening 114 may be located in a center of the rectangular cross-sectional shape of the base 102.

In one embodiment, the at least one loose combs 106 may have spacing between each bristle 108 defined by a line 132 (also referred to as spacing 132). In one embodiment, the at least one tight combs 110 may have spacing between each bristle 112 defined by a line 134 (also referred to as spacing 134).

In one embodiment, the spacing 132 between each bristle 108 of the at least one loose combs 106 is greater than the spacing 134 between each bristle 112 of the at least one tight combs 110. In one embodiment, the spacing 132 between each bristle 108 of the at least one loose combs 106 may be approximately 0.25 cm+/−1 cm (e.g., greater than 0 and up to 1.25 cm). In one embodiment, the spacing 134 between each bristle 112 of the at least one tight combs 110 may be approximately 0.15 cm+/−0.75 cm (e.g., greater than 0 and less than the spacing 132 and up to 0.90 cm).

In one embodiment, the spacing 132 and the spacing 134 may be measured from a middle point along the length of the bristles 108 or the bristles 112. For example, the width of the bristles 108 and 112 may be wider at a bottom versus a top of the bristles. As a result, the spacing 132 and the spacing 134 may vary depending on where the spacing is measured along a length of the bristle 108 or 112.

Figure 7:
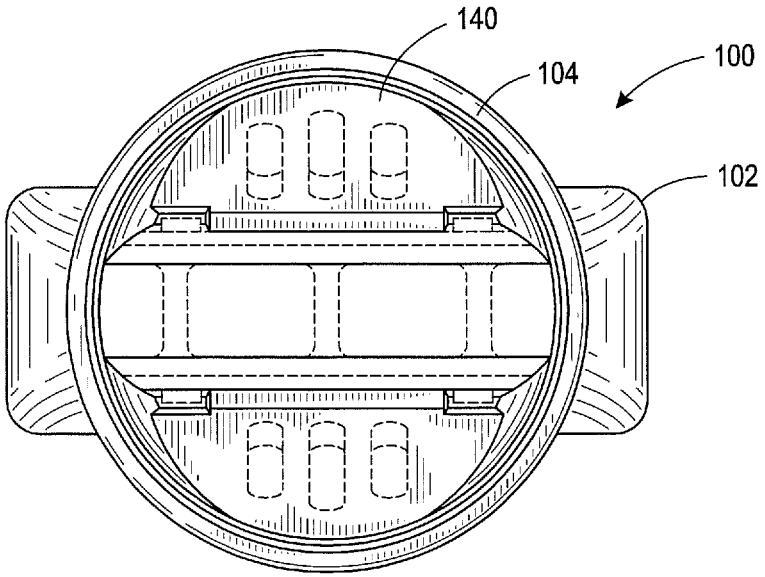
FIG. 7 depicts a bottom view of one embodiment of the hair dryer pik attachment of the present disclosure.

FIG. 7 illustrates a bottom view of one embodiment of the hair dryer pik attachment 100. In one embodiment, the hair dryer attachment portion 104 may have an opening 140 that is sized to receive a blowing end of a hair dryer (not shown). In one embodiment, the opening 140 may be molded to fit a specific size or brand of hair dryer via an interference fit, friction fit, snap fit, and the like. In another embodiment, the opening 140 may be designed to be a universal fit for any type, size or brand hair dryer.

Figure 8:
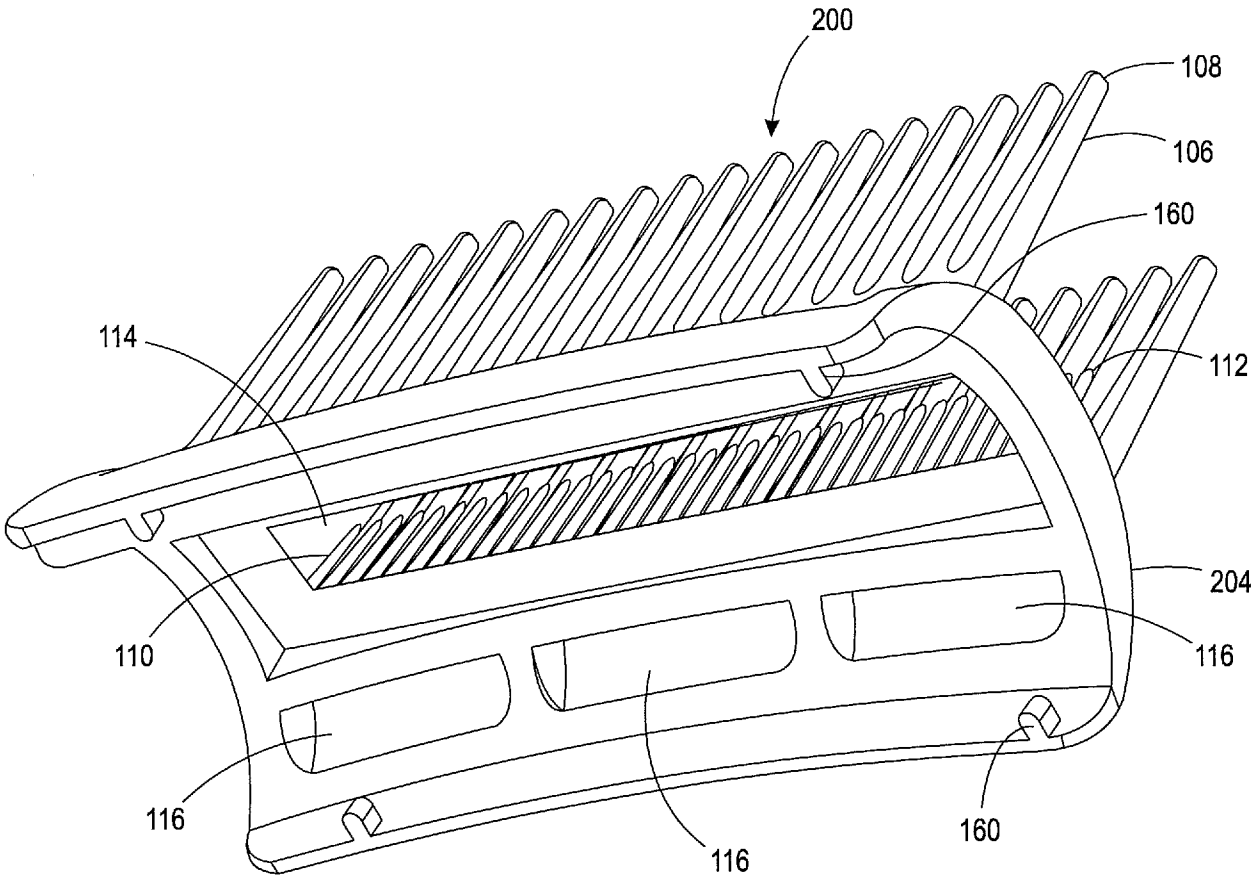
FIG. 8 depicts an isometric bottom view of a second embodiment of the hair dryer pik attachment of the present disclosure.

FIG. 8 illustrates an isometric bottom view of an alternative embodiment of a hair dryer pik attachment 200. The alternative embodiment of the hair dryer pik attachment 200 may have different design for a hair dryer attachment portion 204. For example, the hair dryer attachment portion 204 may have curved rectangular shape rather than a circular or cylindrical shape of the hair dryer attachment portion 104 of the hair dryer pik attachment 100.

In addition, the hair dryer attachment portion 204 may have one or more tabs 160 that may be used to slide the hair dryer pik attachment 200 onto a bottom portion of a hair dryer. The one or more tabs 160 may hold and lock the hair dryer pik attachment 200 onto the hair dryer. For example, traditional hair dryers may have a cylindrical end that the hair dryer attachment portion 104 may slide onto. However, other types of hair dryers may have a curved rectangular shaped opening for blowing hot hair out of a bottom portion of the hair dryer that the hair dryer attachment portion 204 may be used to slide over.

In one embodiment, the at least one row of loose combs 106 and the hair dryer attachment portion 204 may be plastic and molded as a single piece. In one embodiment, the at least one row of tight combs 110 may be mechanically coupled to the hair dryer attachment portion 204 and may be fabricated from a conductive metal, similar to the at least one row of tight combs 110 of the hair dryer pik attachment 100.

In one embodiment, the hair dryer attachment portion 204 may also serve as the base. In other words, the hair dryer pik attachment 200 may not have the base 102 that is in the hair dryer pik attachment 100, as illustrated in FIG. 1 and described above. In another embodiment, the top surface of the hair dryer attachment portion 204 may be considered to be the "base" to attach the at least one row of loose combs 106 and the at least one row of tight combs 110.

In addition, the hair dryer pik attachment 200 may have more bristles 108 for the at least one row of loose combs 106 and more bristles 112 for the at least one row of tight combs 110 due to the longer overall length of the hair dryer pik attachment 200 compared to the hair dryer pik attachment 100. Otherwise, the hair dryer pik attachment 200 may have similar features as the hair dryer pik attachment 100. For example, the hair dryer pik attachment 200 may also include the center opening 114 and the one or more openings 116 in the hair dryer attachment portion 204.

Thus, embodiments of the present disclosure provide a hair dryer pik attachment 100 that provides a more efficient straightening and drying of hair for individuals with thick coarse hair. For example, the novel design of the hair dryer pik attachment 100 eliminates the need to stop and change attachments during hair styling.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A hair dryer pik attachment, comprising:

a base, wherein the base comprises an opening;

at least one row of loose combs coupled to a top of the base;

at least one row of tight combs, wherein a bottom of the at least one row of tight combs is coupled to an uppermost surface of the top of the base and adjacent to the loose combs and the opening, wherein the at least one row of loose combs and the at least one row of tight combs comprise bristles, wherein a spacing between each of the bristles of the at least one row of loose combs is greater than a spacing between each of the bristles of the at least one row of tight combs, wherein the spacing between each of the bristles of the at least one row of tight combs is approximately 0.15 centimeters measured from a middle point along a length of the bristles of the at least one row of tight combs, wherein a length of each of the bristles of the at least one row of loose combs is greater than the length of each of the bristles of the at least one row of tight combs, wherein the length of each of the bristles of the at least one row of loose combs is greater than a width of each of the bristles of the at least one row of loose combs and the length of each of the bristles of the at least one row of tight combs is greater than a width of each of the bristles of the at least one row of tight combs, wherein a ratio of the length of each of the bristles of the at least one row of loose combs to the length of each of the bristles of the at least one row of tight combs is between a range of 5-2, wherein the at least one row of loose combs comprises two rows of loose combs coupled along a length of each outer side of the base, wherein the at least one row of tight combs comprises two rows of tight combs coupled along the length of the base adjacent to the two rows of loose combs, wherein the opening is between the two rows of tight combs; and a hair dryer attachment portion coupled to a bottom of the base, wherein the hair dryer attachment portion comprises one or more openings on opposing sides to promote air flow and prevent over-heating.

2. The hair dryer pik attachment of claim 1, wherein the base, the at least one row of loose combs and the hair dryer attachment portion comprise a single molded plastic piece.

3. The hair dryer pik attachment of claim 1, wherein the at least one row of tight combs is coupled to the base via a mechanical coupling.

4. The hair dryer pik attachment of claim 3, wherein the mechanical coupling comprises a snap fit.

5. The hair dryer pik attachment of claim 1, wherein the at least one row of tight combs comprises a conductive metal.

6. The hair dryer pik attachment of claim 1, wherein the length of each of the bristles of the at least one row of loose combs is approximately 2 centimeters or greater.

7. The hair dryer pik attachment of claim 6, wherein the length of each of the bristles of the at least one row of tight combs is approximately 1 centimeter or greater and less than the length of each bristle of the at least one row of loose combs.

8. The hair dryer pik attachment of claim 1, wherein a distance between the two rows of loose combs is approximately 1 centimeter or greater.

9. The hair dryer pik attachment of claim 1, wherein a distance between the two rows of tight combs is approximately 0.5 centimeters or greater.

10. The hair dryer pik attachment of claim 1, wherein the hair dryer attachment portion comprises a curved rectangular shape and one or more tabs for sliding onto a hair dryer.

11. A hair dryer pik attachment, comprising:

a base, wherein the base comprises an opening;

a first means for straightening hair coupled to a top of the base;

a second means for straightening and drying the hair, wherein a bottom of the second means for straightening and drying the hair is coupled to an uppermost surface of the top of the base and adjacent to the first means for straightening the hair, wherein the first means for straightening and the second means for straightening and drying the hair comprise bristles, wherein a spacing between each of the bristles of the first means for straightening hair is greater than a spacing between each of the bristles of the second means for straightening and drying hair, wherein the spacing between each of the bristles of the second means for straightening and drying hair is approximately 0.15 centimeters measured from a middle point along a length of the bristles of the second means for straightening and drying the hair, wherein a length of each of the bristles of the first means for straightening hair is greater than the length of each of the bristles of the second means for straightening and drying hair, wherein the length of each of the bristles of the first means for straightening hair is greater than a width of each of the bristles of the first means for straightening hair and the length of each of the bristles of the second means for straightening and drying hair is greater than a width of each of the bristles of the second means for straightening and drying hair, wherein a ratio of the length of each of the bristles of the first means for straightening hair to the length of each of the bristles of the second means for straightening and drying hair is between a range of 5-2, wherein the first means for straightening hair comprises two rows of the first means for straightening hair coupled along a length of each outer side of the base, wherein the second means for straightening and drying hair comprises two rows of the second means for straightening and drying hair coupled along the length of the base adjacent to the two rows of the first means for straightening hair, wherein the opening is between the two rows of the second means for straightening and drying hair; and a means for attaching to a hair dryer coupled to a bottom of the base, wherein the means for attaching to the hair dryer comprises one or more openings on opposing sides to promote air flow and prevent over-heating.

12. The hair dryer pik attachment of claim 11, wherein the second means for straightening and drying the hair comprises a conductive metal.

13. The hair dryer pik attachment of claim 11, wherein a distance between the two rows of the first means for straightening the hair is approximately 1 centimeter or greater and wherein a distance between the two rows of the second means for straightening and drying the hair is approximately 0.5 centimeters or greater.

14. A hair dryer pik attachment, comprising:

a base, comprising a rectangular cross section having a length that is longer than a width and an opening in a center of the rectangular cross section;

a first row of loose combs coupled along the length on a first side of a top of the base;

a second row of loose combs coupled along the length on a second side of the base, wherein the second side is opposite the first side;

a first row of tight combs, wherein a bottom of the first row of tight combs is coupled along the length on the first side of an uppermost surface of the top of the base and adjacent to the first row of loose combs and the opening;

a second row of tight combs, wherein a bottom of the second row of tight combs is coupled along the length of the second side of the uppermost surface of the base and adjacent to the second row of loose combs and the opening, wherein the first row of loose combs, the second row of loose combs, the first row of tight combs and the second row of tight combs comprise bristles, wherein a spacing between each of the bristles of the first row of loose combs and the second row of loose combs is greater than a spacing between each of the bristles of the first row of tight combs and the second row of tight combs, wherein the spacing between each of the bristles of the first row of tight combs and the second row of tight combs is approximately 0.15 centimeters measured from a middle point along a length of the bristles of the first row of tight combs and the second row of tight combs, wherein a length of each of the bristles of the first row of loose combs and the second row of loose combs is greater than the length of each of the bristles of the first row of tight combs and the second row of tight combs, wherein the length of each of the bristles of the first row of loose combs and the second row of loose combs is greater than a width of each of the bristles of the first row of loose combs and the second row of loose combs and the length of each of the bristles of the first row of tight combs and the second row of tight combs is greater than a width of each of the bristles of the first row of tight combs and the second row of tight combs, wherein a ratio of the length of each of the bristles of the first row of loose combs and the second row of loose combs to the length of each of the bristles of the first row of tight combs and the second row of tight combs is between a range of 5-2; and a hair dryer attachment portion coupled to a bottom of the base, wherein the hair dryer attachment portion comprises one or more first openings on a first portion that is coupled to the first side of the top of the base and one or more second openings on a second portion that is coupled to the second side of the top of the base to promote air flow and prevent over-heating.

* * * * *